US007793590B2

(12) United States Patent
Kubert

(10) Patent No.: US 7,793,590 B2
(45) Date of Patent: Sep. 14, 2010

(54) SYSTEM AND METHOD FOR FORMING DEBIT CARD USING IMPROVED PRINT CYLINDER MECHANISM

(75) Inventor: Vincent Kubert, Melbourne, FL (US)

(73) Assignee: T.S.D. LLC, Sebastian, FL (US)

( * ) Notice: Subject to any disclaimer, the term of this patent is extended or adjusted under 35 U.S.C. 154(b) by 203 days.

(21) Appl. No.: 12/120,848

(22) Filed: May 15, 2008

(65) Prior Publication Data

US 2009/0282994 A1 Nov. 19, 2009

(51) Int. Cl.
*B41F 33/00* (2006.01)

(52) U.S. Cl. ..... 101/483; 101/142

(58) Field of Classification Search ..... 101/483, 101/142

See application file for complete search history.

(56) References Cited

U.S. PATENT DOCUMENTS

| | | | | | |
|---|---|---|---|---|---|
| 3,540,372 | A * | 11/1970 | Chambon | 101/92 |
| 3,889,596 | A * | 6/1975 | Thomas et al. | 101/154 |
| 4,239,001 | A * | 12/1980 | Kataoka | 101/152 |
| 4,901,641 | A * | 2/1990 | Steiner et al. | 101/152 |
| 5,031,532 | A * | 7/1991 | Walther | 101/351.4 |
| 5,520,109 | A | 5/1996 | Meschi | 101/247 |
| 5,558,021 | A * | 9/1996 | Erhard et al. | 101/232 |
| 5,737,090 | A * | 4/1998 | Christopher et al. | 358/3.29 |
| 6,199,757 | B1 | 3/2001 | Kubert | 235/380 |
| 6,272,986 | B1 | 8/2001 | Hess | 101/137 |
| 6,308,991 | B1 | 10/2001 | Royer | 283/102 |
| 6,405,930 | B1 | 6/2002 | Kubert | 235/487 |
| 6,419,794 | B2 * | 7/2002 | Kustermann | 162/252 |
| 6,561,416 | B2 | 5/2003 | Kubert et al. | 235/375 |
| 6,609,662 | B2 | 8/2003 | Annacone et al. | 235/487 |
| 6,729,656 | B2 | 5/2004 | Kubert et al. | 283/100 |
| 6,817,689 | B1 | 11/2004 | Annacone | 347/2 |
| 6,932,451 | B2 | 8/2005 | Annacone | 347/2 |
| 7,219,603 | B2 | 5/2007 | Ishikawa | 101/351.3 |
| 2001/0045742 | A1 * | 11/2001 | Schulz | 283/94 |
| 2002/0134267 | A1 | 9/2002 | Kolbe et al. | 101/484 |
| 2006/0107852 | A1 | 5/2006 | Motard | 101/142 |

FOREIGN PATENT DOCUMENTS

| | | |
|---|---|---|
| CA | 1190987 | 7/1985 |
| EP | 0 767 054 | 2/1996 |
| EP | 1 800 864 | 8/2001 |
| WO | 97/43126 | 11/1997 |

* cited by examiner

*Primary Examiner*—Anthony H. Nguyen
(74) *Attorney, Agent, or Firm*—Allen, Dyer, Doppelt, Milbrath & Gilchrist, P.A.

(57) ABSTRACT

A flexographic printing station prints at least one print stripe of opaque scratch-off coating onto the surface of the card over a PIN as a card member is advanced into a printing station. A print cylinder has a circumferential printing surface that engages an Anilox metering roll and receives the scratch-off coating therefrom and transfers the scratch-off coating from the printing surface onto the surface of the debit card. A controller controls movement of the print cylinder via a mounting mechanism into and out of engagement with the surface of the debit card at a predetermined location and for a predetermined length of time to apply at least one print stripe of predetermined length onto the surface of the debit card based on the length of time the printing surface engages the surface of the debit card.

25 Claims, 5 Drawing Sheets

SYSTEM AND METHOD FOR FORMING DEBIT CARD USING IMPROVED PRINT CYLINDER MECHANISM

FIELD OF THE INVENTION

This invention relates to flexographic printing, and more particularly, this invention relates to producing debit cards.

BACKGROUND OF THE INVENTION

Commonly assigned U.S. Pat. No. 6,729,656, the disclosure which is hereby incorporated by reference in its entirety, discloses a system and method of forming a debit card having a personal identification number (PIN) radiation cured, opaque scratch-off coating applied over the PIN. A card supply feeds cards that are advanced along a predetermined path of travel on a conveyor into various print stations where the personal identification number (PIN) is printed onto the surface of the card, such as by inkjet printing, followed by advancement into successive print stations for further processing. A first print station prints a release coating over the PIN. A second print station prints a scratch-off coating. A third print station applies a second or subsequent ink layer or other coating over the opaque scratch-off coating.

The print stations include an Anilox metering roll and a plate cylinder having impression plates as print pads as commonly used in flexographic printing stations that print a "stripe," i.e., a strip of material such as an ink, for example, in the form of a release coating or scratch-off coating, of predetermined thickness and predetermined length as defined by the type of plate cylinder and impression plate on the print pad. This particular "stripe" or strip of release coating or scratch-off coating is of a predetermined length, width, and position on the card resulting from the configuration of the print cylinder and its print pad positioned on the print cylinder's periphery and timing relationship relative to the advancing card. In this type of system, however, there is no variation in the length or number of stripes that can be printed on the card. There are many applications, however, where a vendor desires to vary the number and length of the stripes depending on individual cards or end use customer requirements.

SUMMARY OF THE INVENTION

A system forms a debit card and includes a conveying mechanism for sequentially advancing planar card members along a predetermined path of travel. Each card has a PIN on one of the surfaces. A flexographic printing station is positioned along the predetermined path of travel for printing at least one print stripe of opaque scratch-off coating onto the surface of the card having the PIN as a card member is advanced into the printing station such that the PIN is covered by at least one print stripe of scratch-off coating. The flexographic printing station includes an Anilox metering roll that receives a scratch-off coating and a print cylinder having a circumferential printing surface that engages the Anilox metering roll and receives the scratch-off coating therefrom and transfers the scratch-off coating from the printing surface onto the surface of the debit card. A drive mechanism continuously rotates the print cylinder with respect to the Anilox metering roll. A mounting mechanism supports the print cylinder for vertical movement with respect to the advancing mechanism and drives the print cylinder into and out of engagement with the surface of the debit card advanced into the flexographic printing station while maintaining sufficient contact with the Anilox metering roll. A controller is operative with the mounting mechanism for controlling movement of the print cylinder into and out of engagement with the surface of the debit card at a predetermined location and for a predetermined length of time to apply at least one print stripe of predetermined length onto the surface of the debit card based on the length of time the printing surface engages the surface of the debit card.

In one aspect, the mounting mechanism is operative such that the setting between the Anilox metering roll and print cylinder is not sufficiently changed to impede adequate transfer of scratch-off coating between the Anilox metering roll and printing surface. The mounting mechanism can be formed as a pivot mount member that supports the print cylinder for pivoting motion about a pivot point at a location such that the print cylinder upon pivoting is raised and lowered with respect to the advancing mechanism. A piston actuator having a piston is connected to the print cylinder and operative from the controller for actuating piston movement and driving the print cylinder into and out of engagement with the debit card.

In yet another aspect, a plurality of parallel print pads form the printing surface for printing parallel print stripes onto the surface of the debit card. In another aspect, the controller is operative with the mounting mechanism for lowering the print cylinder into engagement with a surface of a debit card a number of times for varying the number and length of print stripes printed on the surface of the debit card. An adjustable stop member can limit downward movement of the print cylinder relative to the advancing mechanism for changing the clearance from the print cylinder and conveying mechanism and adjusting to a different debit card thickness for developing a predetermined pressure to be exerted onto the surface of the debit card. The adjustable stop member can limit upward movement of the print cylinder relative to the advancing mechanism for ensuring that the print cylinder is sufficiently clear of the advancing mechanism for advancing debit cards.

In yet another aspect, a radiation curing station is located along the path of travel for radiation curing the scratch-off coating. This radiation curing station can be formed as an ultraviolet radiation curing station. The printing station can also print a security indicia on the opaque scratch-off coating. A flexographic printing station can be positioned along the predetermined path of travel for printing a release coating onto the surface of the PIN before printing the opaque scratch-off coating.

A method aspect is also set forth. The flexographic printing process as described can be used for any printing of ink on a substrate.

BRIEF DESCRIPTION OF THE DRAWINGS

Other objects, features and advantages will become apparent from the detailed description of the preferred embodiments which follows, when considered in light of the accompanying drawings in which.

DETAILED DESCRIPTION OF THE PREFERRED EMBODIMENTS

Different embodiments will now be described more fully hereinafter with reference to the accompanying drawings, in which preferred embodiments are shown. Many different forms can be set forth and described embodiments should not be construed as limited to the embodiments set forth herein. Rather, these embodiments are provided so that this disclosure will be thorough and complete, and will fully convey the scope to those skilled in the art. Like numbers refer to like elements throughout.

Figure 1:
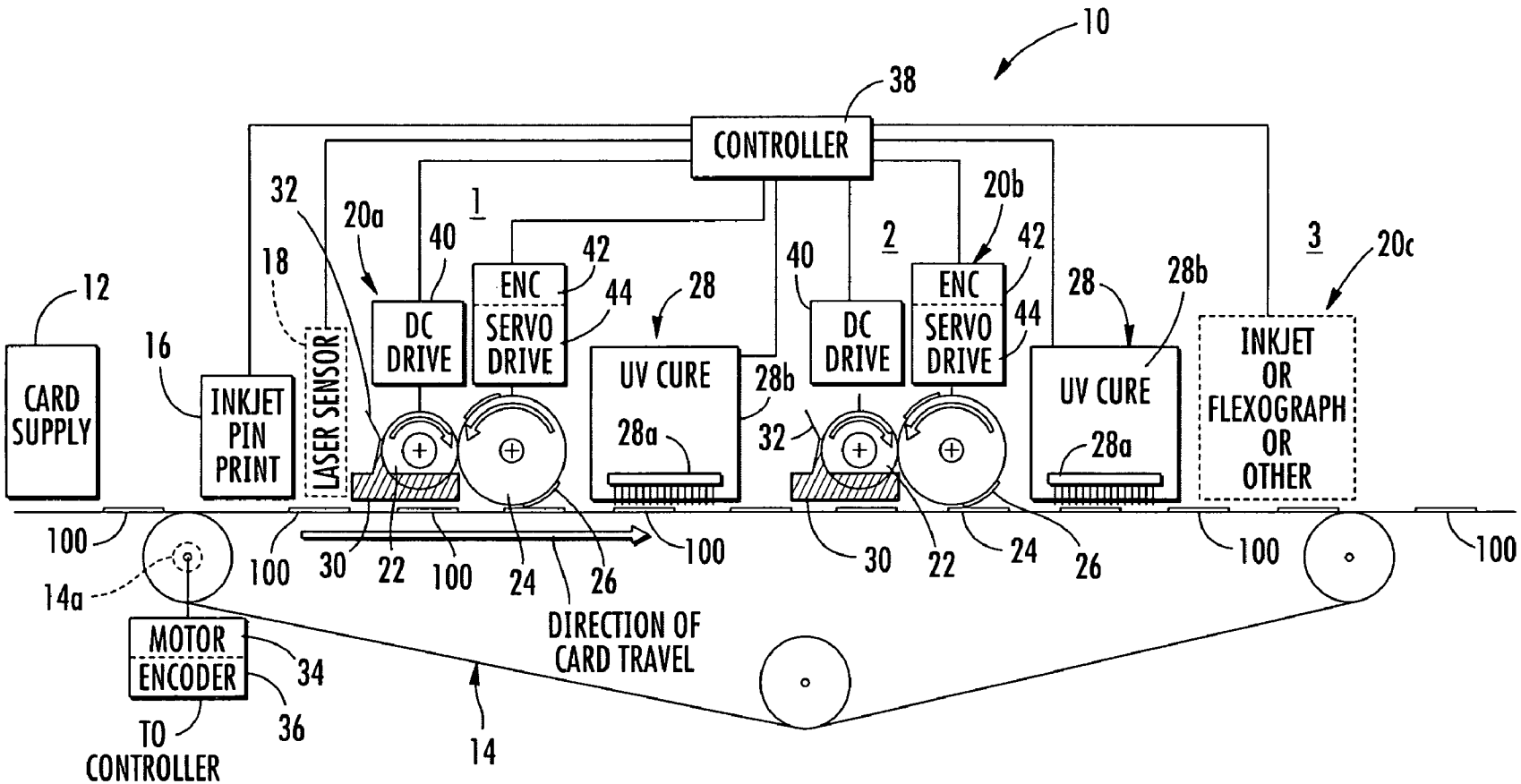
FIG. 1 is a block diagram of a system for producing a debit card and showing basic components used in forming a debit card such as disclosed in the commonly assigned and incorporated by reference U.S. Pat. No. 6,729,656.

FIG. 1 is a block diagram of a system and apparatus used for producing a debit card such as disclosed in the incorporated by reference and commonly assigned U.S. Pat. No. 6,729,656, showing basic components used in various print stations for printing debit cards or other substrates with a print "strip" or "stripe" of ink such as an ink layer that corresponds to a scratch-off coating on a planar substrate such as a debit or calling card. The printed medium could be ink, a release coating, a scratch-off material or other similar material. In one aspect, the general term "ink" can correspond to many different materials that are printed, such as a release coating or scratch-off coating. The print station shown in FIGS. 2 and 3 can be used in the various print stations described relative to the system shown in FIG. 1.

Figure 2:
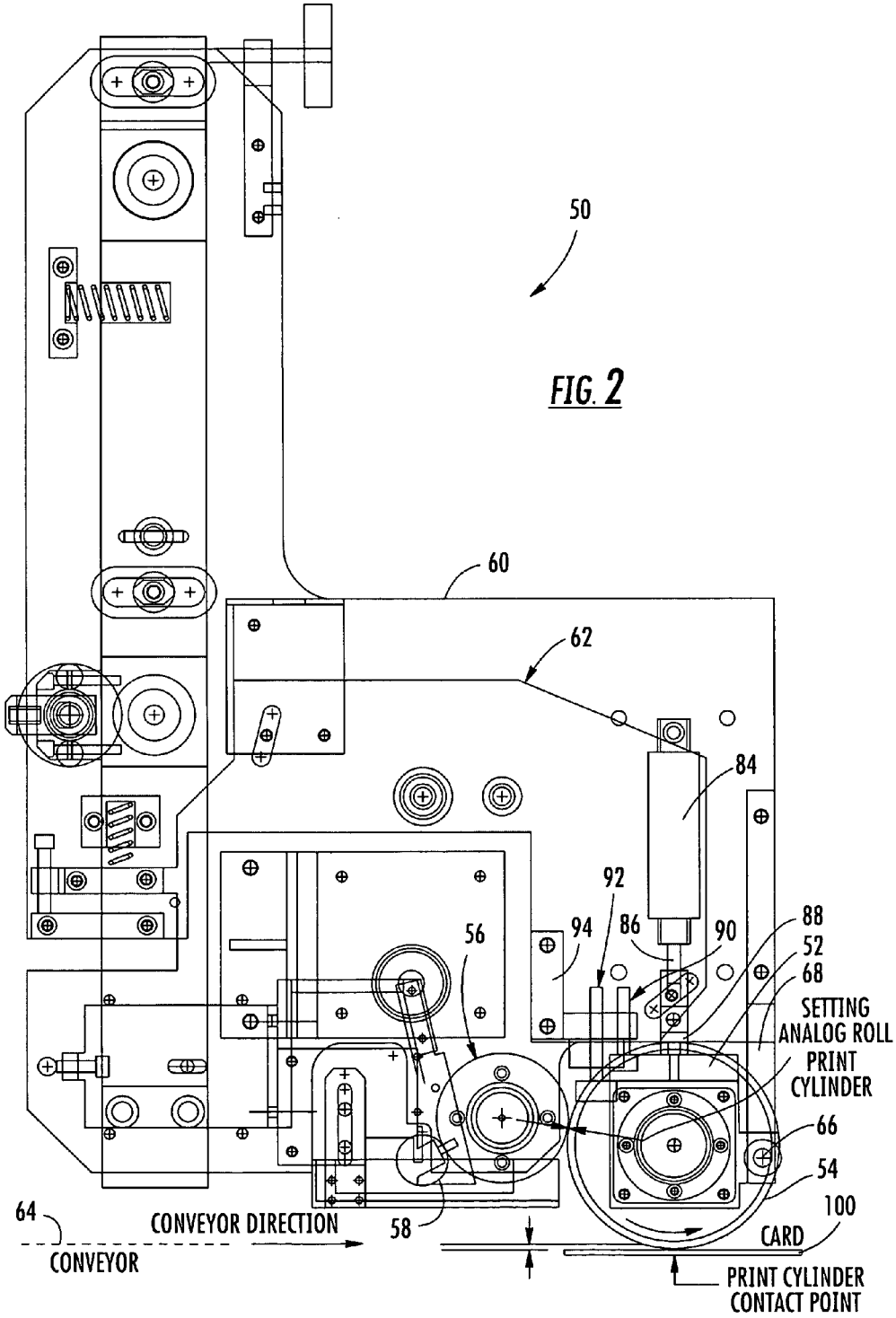
FIG. 2 is a side elevation view of the print station that can be incorporated into the printing system shown in FIG. 1 for printing "stripes" of different configurations.
Figure 3:
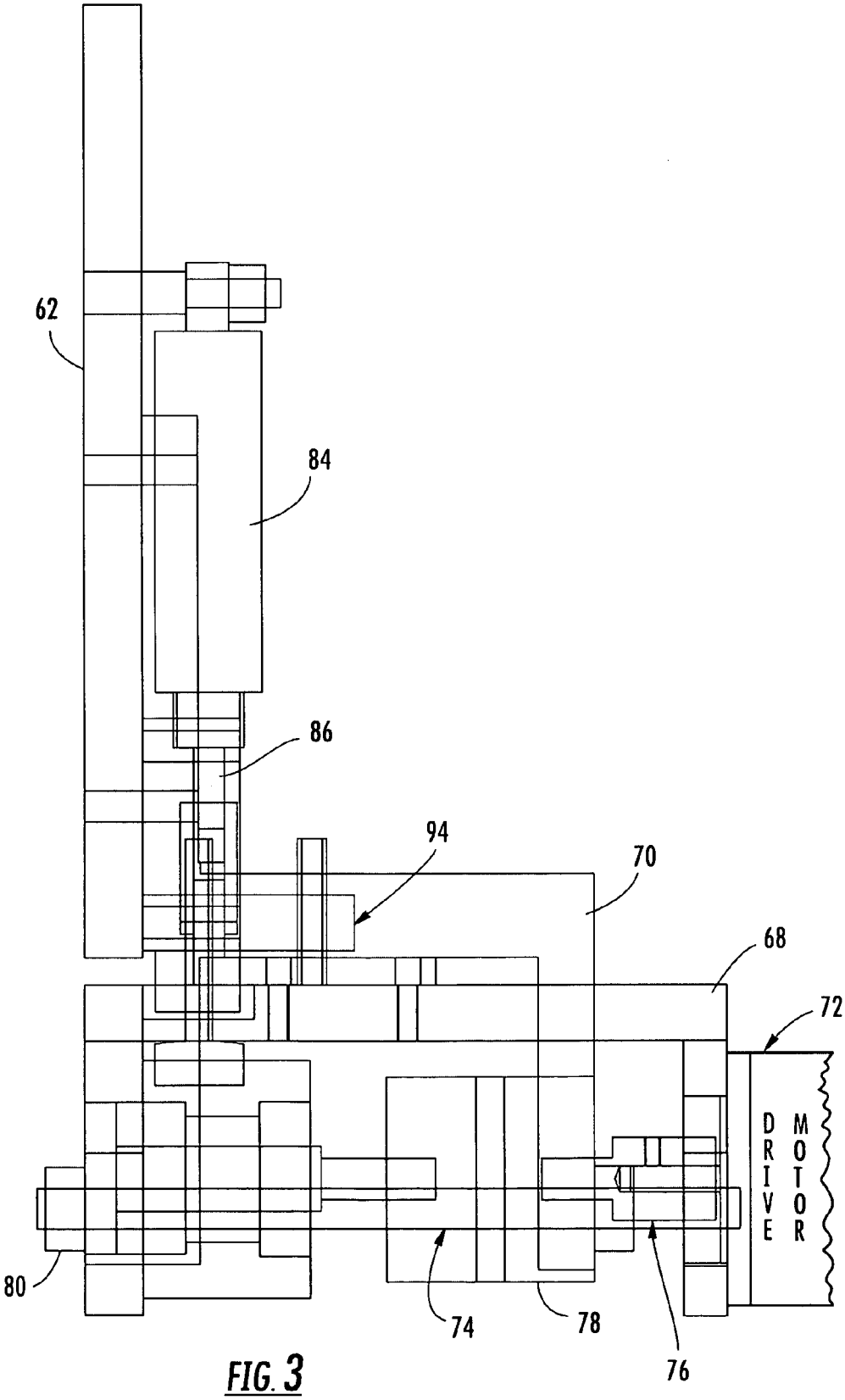
FIG. 3 is a fragmentary, front elevation view of the print station shown in FIG. 2.

Referring now to FIG. 1, there is illustrated at 10 a general block diagram of the system and apparatus that can be used for forming the debit card and can be modified to include the print stations shown in FIGS. 2 and 3. A card supply 12, such as a card hopper, stores planar card members that are to be advanced along a predetermined path of travel via a conveyor system 14, typically a belt conveyor having a vacuum draw mechanism for securing cards and other articles thereon. An example of such card supply 12 and conveyor system 14 could be the type disclosed in the incorporated by reference and commonly assigned U.S. Pat. No. 6,199,757 to Profold, Inc. of Sebastian, Fla. Naturally, the system, apparatus and method is not limited to such belt conveyor systems, and other card conveyance systems could be used as suggested by those skilled in the art.

Although different planar card members can be used in the system shown in FIG. 1, a typical planar card members can be formed as a plastic substrate, including plastics such as polyvinyl chloride (PVC), acrylonitrile-butadiene-styrene (ABS), other styrene polymers, polyester (PET), and other materials commonly used for substrates in the credit card and telephone calling card industry. Typically, the substrate thickness varies from about 0.007 inches up to about 0.032 inches. Also, in other aspects, common single ply, but somewhat thick and rigid paper, or multi-ply or other different paper substrates, could be used.

As shown in FIG. 1, the system 10 includes a PIN print station 16 where personal identification numbers (PIN's) are printed on a surface of the debit card, such as by an ink jet printer or other print means. The print station 16 prints onto the surface of planar card members as they advance along a predetermined path of travel defined by the conveyor 14. It is possible that the card members could be printed with PIN's off-line, or in another location in an in-line position. The illustrated embodiment, however, shows the ink jet printing of PINTs occurring just before sensing of the cards by a laser sensor 18. Three print stations 20*a*, 20*b* and 20*c* are labeled 1, 2 and 3 and positioned adjacent the conveyor 14. The first two print stations 20*a* , 20*b* include a metering roll 22 in the form of an Anilox metering roll, a plate cylinder 24 having impression plates (print pads) 26 as commonly used in flexographic printing systems, and an ultraviolet curing station 28 in the form of an ultraviolet curing lamp. The third station 20*c* could be a similar station as stations 1 and 2, or could be an ink jet spray station or other printing station that applies a second and/or subsequent ink layers or other coatings over the opaque scratch-off coating.

After the PIN is printed onto the surface of the planar card member by PIN print station 16, the debit card is advanced in a predetermined path of travel by the belt conveyor where, in one aspect of the invention, a release coating is applied over the PIN. The release coating is typically less than about 2 mil thickness and preferably about 0.0002 to about 0.0005 inches thick and could range up to about 0.002 inches. The release coating is preferably transparent, but it does not have to be necessarily clear, but could be color tinted for aesthetic purposes. Typically, the release coating (if used) should be of a thickness and color such that the PIN can be seen through the release coating.

In a preferred aspect, the release coating is applied by printing the release coating using a metering roll 22 and impression plate 26 in a flexographic printing process. Other printing methods that could be used include rotary letter press, offset (lithography), gravure, and rotary screen printing methods. The preferred printing method has been found to be the flexographic printing method, and includes an ink reservoir 30 in the form of an ink bath container. The bath container 30 holds the ink in liquid form, which could be the release material or scratch-off material in this non-limiting example. The ink bath container 30 could be a chambered doctor blade system or other enclosed doctor blade system. Although an open system is illustrated for purposes of description, a chambered doctor blade system would provide cleaner operation.

The Anilox metering roll 22, as known to those skilled in the art, is contained within the ink bath and includes a common knurled or other surface. A doctor blade 32 is operative with the metering roll 22 for engaging close to the metering roll and removing part of the liquid or ink in the form of the release material or scratch-off material from the Anilox metering roll.

The plate cylinder 24 has impression plates 26 in the form of print pads mounted thereon that engage the Anilox metering roll and transfers the release or scratch-off coating material from the plate (pads) onto the surface of the planar card member. The plate cylinder 24 is a generic term describing many types of flexographic design options. A barbell configuration could support two print pads 26. Other designs could support three or four print pads, essentially doubling throughput when four print pads are used. The impression plates (print pads) 26 can be formed of any type of material commonly known to those skilled in the art, including rubber print pads or photopolymer plates 26 and/or other flexible plate or pad material, typically known and used by those skilled in the art.

The release coating can be applied in a printing manner similar to any ink coating applied in printing techniques, including the preferred flexographic techniques. This release coating can, thus, be referred to as a printed ink coating that is applied onto the surface of the card over the PIN and radiation/ultraviolet cured by the preferred ultraviolet curing lamp 28, which uses an ultraviolet bulb 28*a* in an ultraviolet lamp housing 28*b*.

The belt conveyor 14 in this illustrated aspect typically includes a servodrive in the form of a servomotor 34 operatively connected onto a support shaft 14*a* of the belt conveyor. An encoder 36 is operatively connected to the shaft 14*a* and a controller 38. The laser sensor 18 is operative with the conveyor, as shown in FIGS. 1 and 2, and is operatively connected to the controller 38. A DC motor drive 40 is operatively connected to the Anilox metering roll 22, but a more accurate servomotor could be used instead of the DC motor drive, especially with high-speed operation. In this illustrated aspect shown in FIG. 1, an encoder 42 and servomotor 44 are operatively connected to the plate cylinder 24 to establish precise and controlled movement of the plate cylinder, and thus, controlled movement of the impression plates (print pads) 26 in timed operation with a card moving under the plate cylinder as the card member advances along its predetermined path of travel. In one aspect of the present invention, the servomotor has about 4,000 pulses per revolution of its output shaft to give high accuracy to the system.

Naturally, a release coating is not always necessary depending on the type of substrate used for the card member. The amount of surface tension created by the card surface has an impact on the removability of opaque scratch-off layers, typically formed as a silver ink, as known to those skilled in the art, such that the scratch-off layer could be removed without damaging the PIN even without a release coating, in some instances.

At the second print station 22*b*, the scratch-off coating is applied after the first print station 22*a* has printed a release coating in this non-limiting example. As is typical, the scratch-off coating can be a silver ink formed of a material known to those skilled in the art, but could be formed of another type of opaque ink. The print station 22*b* is similar in design to the first print station 22*a* and includes the basic printing components as described before, including an Anilox metering roll 22 and plate cylinder 24, the appropriate ink well or reservoir 30, doctor blade 32, DC motor drive 40, servodrive mechanism in the form of a precisely controlled servomotor 44, encoder 42, and impression plates or print pads 26 contained on the plate cylinder. A second ultraviolet curing station (lamp) 28 provides for radiation curing of the printed ink in the form of the opaque scratch-off coating. Although ultraviolet curing is the preferred method of curing as described, it is possible in some cases to use other types of radiation curing, including the possible use of electron beam, blue light, laser or other radiation curing methods known to those skilled in the art.

In one aspect, the ultraviolet curing stations 28 are an ultraviolet, modular curing subsystems, such as manufactured and sold by Uvexs of Sunnyville, Calif. Such ultraviolet curing stations include an ultraviolet lamp housing that could use a metal halide, mercury vapor, or other type of ultraviolet lamp known to those skilled in the art with power levels ranging from as low as about 100 watts/inch to as high as about 600 watts/inch. If a release coating is applied, then a mercury vapor lamp could be used. For the opaque scratch-off coating, a metal halide lamp is preferred, but of course, other lamps could be used as suggested by those skilled in the art. The station could have remote operating controls for operator control at a console located a distance from the system, and an adequate power supply for direct ultraviolet exposure (and infrared filter exposure in some cases). The station 28 could also include an internal shutter and a digital exposure timer having a continuous variable power control.

The station 28 could provide surface and in-depth curing for high intensity, full spectrum ultraviolet energy from about 200 to about 400 nanometers. The lamp lengths can vary from as little as 2 to about 80 or more inches and include a single medium pressure mercury vapor, metal halide, or other lamp. Internal cooling fans could be provided with appropriate venting using vent systems. A reflector could be included in the oven for unfiltered and filtered infrared operation. The shutter could allow exposure control and could be provided by an internally mounted knife blade shutter using a pneumatic cylinder to drive the shutter plate at an adjustable open/close rate. Clean dry air or nitrogen could be used for efficient curing operation. The shutter control could include a pneumatic switch and digital timer for open/close functions. A programmable logic control (PLC) can be used as an interface connector using techniques known to those skilled in the art. Variable power control can provide power control over the ultraviolet lamp.

The third print station 20*c* can be used for personalization and can include a similarly fabricated, flexographic print station as described for the first and second print stations, or could be another type of printing apparatus besides the described flexograph type of printing station. The third print station 20*c* applies a second coat of ink, scratch-off coating material, or other printed indicia over the first scratch-off coating. Naturally, the print station 20*c* location would vary if it is used to print a layer over the PIN before application of the scratch-off coating. The third print station could be an ink jet print station and apply a fingerprint pattern or similar pattern that is opaque over (or under depending on position of the print station) the scratch-off coating. Also the ink jet printing could apply a security indicia on the opaque scratch-off coating that could be a control code. Thus, if the scratch-off coating and control code were removed, and a scratch-off label applied in its place, then a user would know that tampering of the card has occurred because there would be no control code. Also, the control code could be used for further security and correspond to other control codes printed on the planar card member. During ink jet printing of the second layer, coating, or indicia after the scratch-off coating has been applied, a typical black ink can be provided, although other ink could be provided as known to those skilled in the art.

The controller 38 could be a personal computer or other controller system as known to those skilled in the art. The ink jet PIN print station 16, laser sensors 18, DC motor drives 40, servodrives (motors) 34, 44, encoders 36, 42, shutter controls for the UV station 28, and any other motors and encoders used for the belt conveyor 14 and other components of the system are all operatively connected to the controller.

In operation with this aspect shown in FIG. 1, the laser sensor 18 senses the leading edge of an advancing card member and registers this edge position to the controller. Throughout the card advancing process, the drive motors and encoder of the conveyor belt drive maintains accurate positional control over the card at all times. The servodrive (motor) 44 that is operatively connected to each of the plate cylinders 24 maintains rotational control to apply the release and scratch-off coatings at a timed moment such that any coatings are applied at a specific location on the surface of a card. The software system can use a "queue" that is internal to a tracking subroutine within the drive encoder and controller that tracks the product with the belt conveyor. If a gap varies between cards, the system still tracks all cards by placing the known location within the "queue" and knowing the time it takes for sensing a card to the time the card moves into a printing station.

In this aspect shown in FIG. 1, the thickness of the scratch-off coating, release coating, or other coatings can be set not only by the configuration of the knurls in any Anilox metering roll, but also by the type of doctor blade setting used in conjunction with the metering roll. The surface speed of the knurled Anilox metering roll is set to the surface speed of the conveyor belt such that the speeds are synchronized. The speeds of the card relative to the curing time can be varied.

The system and method described relative to FIG. 1 as set forth in this incorporated by reference and commonly assigned U.S. Pat. No. 6,729,656 provides a system and apparatus that can process credit and debit cards and similar items quickly at up to about 30,000 to 50,000 cards per hour and about 500 to about 800 cards per minute, depending on the type of card, the number of print stations, and the thickness of any applied layers. Solvent coatings can be used. It is possible to use coatings that are a two part system that cures similar to epoxy. The Anilox metering roll and plate cylinder could be supported on respective support or drive shafts mounted for rotation in respective bearing housings. Different motor mounts or stands can include various support plates to support the servo motor and drive motor. Different timing belt systems can be used.

Referring now to FIG. 2, there is illustrated a fragmentary, side elevation view of a modified print station 50 that can be used in the print stations 1, 2, or 3 in the system and apparatus shown in FIG. 1 and will not require the precise timing relative to the card conveyor and rotation of a print cylinder to align a print plate with the card or other substrate. The print station 50 includes a constantly rotating print cylinder 52 having a circumferential printing surface 54 such as formed by at least one circumferentially extending print pad. The print cylinder 52 can be driven into engagement with a debit card (or other substrate). Because it is continuously rotating, the printing surface need only be driven down to engage the card as it is advanced. This print station can print different numbers and lengths of print "stripes" instead of only one as described before with the description relative to FIG. 1. Of course, the print station 50 can be used in many different printer systems besides that illustrated in FIG. 1.

In this improved apparatus, the Anilox metering roll 56 can be similarly formed as in the print station 50 shown in FIG. 1 and include an open or closed ink reservoir 58 and be driven in a similar manner as that Anilox metering roll described relative to FIG. 1. An open reservoir is illustrated. The print station 50 includes a support plate 60 that supports a mounting mechanism 62 for supporting the print cylinder for vertical movement with respect to the advancing mechanism (such as a conveyor) 64 and driving the print cylinder into and out of engagement with the surface of the debit card 100 (or other substrate). The print cylinder 52 is pivotally mounted by a pivot pin 66 supported on a pivot bracket 68. The Anilox metering roll 56 and drive cylinder 52 are supported for rotation by a support bracket 70, which also supports a drive motor 72 and output shaft 74 coupled to the motor 72 using a shaft adapter 76 and shaft and motor coupling 78 (FIG. 3). This part of the mounting mechanism forms a pivot mount member and the out shaft 74 is secured at the end by a collar 80. The drive motor 72 can rotate the print cylinder 52 and the Anilox metering roll 56.

The print cylinder 52 can be rotated slightly about its pivot pin 66 to raise and lower the printing cylinder approximately 0.020 inches in one non-limiting example without materially changing the setting between the Anilox roll 56 and the print cylinder 52. This rotating movement is driven by a hydraulic, pneumatic or other cylinder 84 that has an output shaft 86 connected to a print cylinder pivot support 88. As the shaft 86 piston drives vertically up or down, it pivots the print cylinder 52 about its pivot pin 66 to raise or lower the print cylinder 52 and bring its printing surface 54 into contact with any debit card, substrate or other material to be printed. As a result, the continuously rotating print cylinder 52 can be driven up and then down at predetermined points to bring the printing surface 54 into contact with any substrate, such as a debit card, and vary the length of print "stripes" that are printed.

For example, it is possible to start and stop the printing of a print stripe at any point along the substrate or debit card. Selected portions of the printing surface 54 can engage surfaces to be printed by pivoting the print cylinder a predetermined number of times onto one surface of a substrate or debit card. By using smaller, more narrow print pads in parallel and extending around the periphery of the print cylinder, the number of print stripes on the card can vary. This system as described is not restricted to any length or type of product. By continually contacting the printing surface 54 on the printing cylinder along a long debit card or other very long substrate, a very long print stripe can be obtained. Also, multiple stripes of the same length can be printed if multiple parallel print pads as a printing surface are used. Examples of such printed patterns are shown in the cards in FIGS. 4 through 7.

Figure 4:
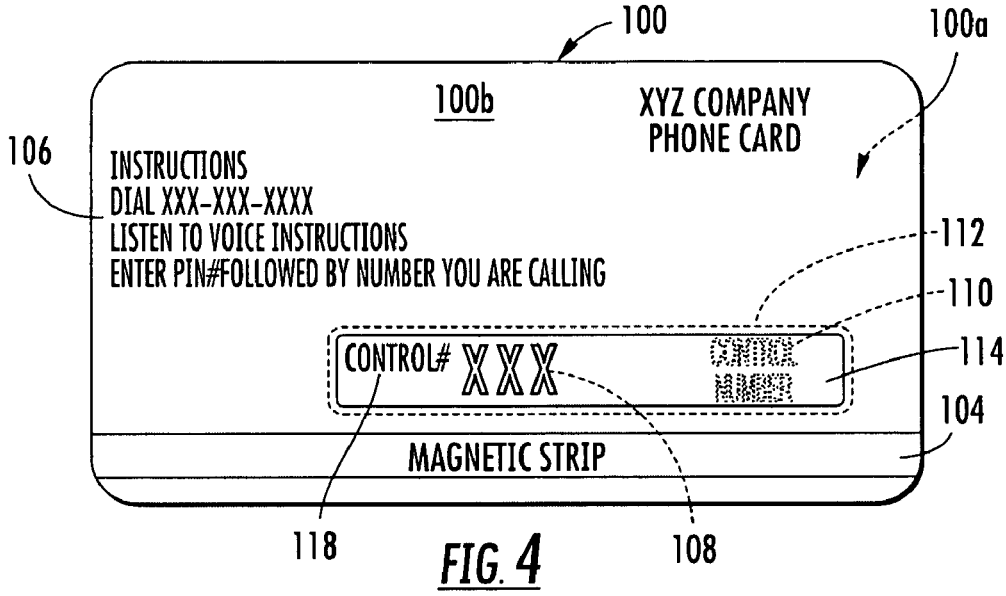
FIGS. 4 through 7 are examples of different debit or similar cards showing different configurations of print stripes that can be applied onto a debit card (or other substrate) and showing the different numbers and lengths of print stripes that can be applied using the print station shown in FIGS. 2 and 3.

FIG. 4 illustrates a debit card 100 having a front face 100*a* (hidden) and rear face 100*b* such as the illustrated phone card. FIG. 4 shows that the phone card 100 includes typical identification information 102 on the front face 100*a*. The rear surface 100*b* includes a magnetic strip 104 as is common with some types of phone cards. Instructions 106 for use of the phone card are included on the rear surface 100*b*. A PIN 108 is printed on the rear surface of the phone card, together with a control number 110 as indicated by the dashed lines for the PIN and control number. A release coating 112 is shown in dashed lines as indicating that a release coating could be applied by a first print station, but does not have to be applied depending on the type of substrate material used for the card member. The scratch-off coating 114 is subsequently applied and shown by the solid line. A second coating 116 can be applied over the scratch-off coating or the scratch-off coating could be the only coating. A second coating could be a security indicia, fingerprint pattern, or could include a security indicia on top as a control code. A control number 118 could be used as a security indicia such that if the scratch-off coating is removed, and a scratch-off label applied in its place, the control number would not be shown on the scratch-off label. The second layer on top of the initial scratch-off coating could be printed black ink as noted before.

Figure 5:
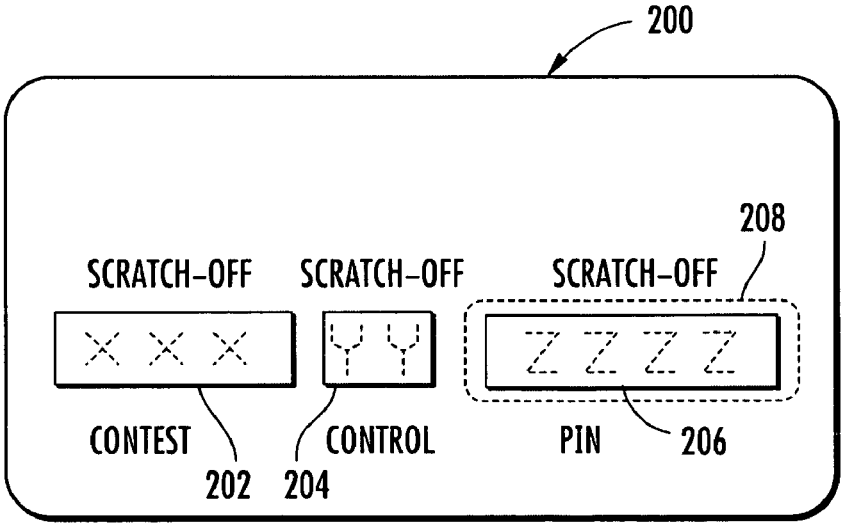
Figure 6:
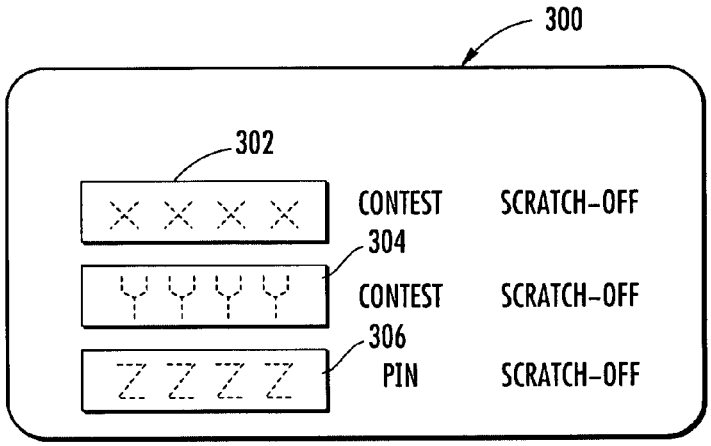
Figure 7:
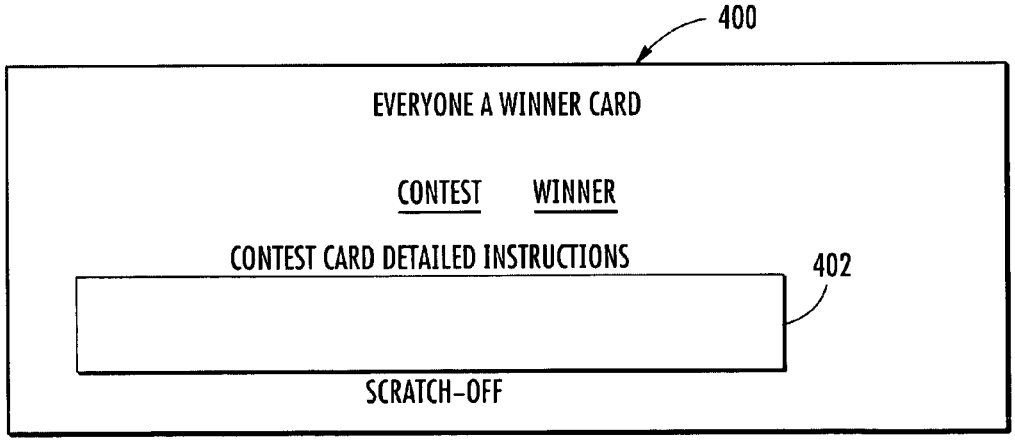

FIG. 5 shows a debit card 200 with three linearly aligned print stripes 202, 204, and 206 printed as a scratch-off coating. The first print stripe 202 could be for a contest code with a scratch-off coating. The second print stripe 204 could be a covering for some other identifier used by the debit or credit card company. The third print stripe 206 could be the scratch-off coating printed over the PIN. As an example, another print stripe 208 or a release coating is seen. FIG. 6 shows a debit card 300 and three print stripes 302, 304, and 306 in parallel. The first print upper stripe 302 could be the applied scratch-off coating over a PIN. The second print stripe could be another scratch-off coating over another code printed concerning some advertisement or game in which the user of the card could scratch off, and if a certain number or other identifier is printed, then the user could obtain a new card or extra minutes, for example. The third or lower print stripe 306 could be the scratch-off coating over other identifying material specific to the card issuer. FIG. 7 is a card 400 with a much larger print stripe 402 as a scratch-off coating covering some instructions for a larger game card, for example.

Adjustments through the use of up and down stop members 90, 92 formed as screws as shown in FIG. 2 and supported by a stop screw bracket 94 can be turned to adjust the range of vertical movement of the print cylinder 52 as it pivots. The down stop member 92 as a screw will adjust the maximum downward movement of the print cylinder. Allowing an increased downward movement could allow greater pressure to be exerted by the printing surface onto a substrate since the printing cylinder is moved closer or in better contact at the print cylinder contact point with a debit card or other substrate. Also, different substrates or debit cards having different thicknesses could be accommodated by varying the downward range at which the print cylinder is stopped when it pivots. Turning the up stop member 90 changes the range of upward movement of the print cylinder, for example (or more), such as varying from 0.01 inches to about 0.03 inches in non-limiting examples. This upward limit could be advantageous to adjust the amount of print material that is applied from the Anilox roll and ensure that proper contact is made to the Anilox roll. It also permits greater thickness materials to be inserted between the conveyor and print cylinder. Also, the Anilox roll could be adjusted to ensure adequate ink or other fluid delivery.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for forming a debit card, comprising:

a conveying mechanism for sequentially advancing planar card members along a predetermined path of travel, each card having a PIN on one of the surfaces;

a flexographic printing station positioned along the predetermined path of travel for printing at least one print stripe of opaque scratch-off coating onto the surface of the card having the PIN as a card member is advanced into the printing station such that the PIN is covered by at least one print stripe of scratch-off coating, said flexographic printing station comprising an Anilox metering roll that receives a scratch-off coating and a print cylinder having a circumferential printing surface that engages the Anilox metering roll and receives the scratch-off coating therefrom and transfers the scratch-off coating from the printing surface onto the surface of the debit card, and further comprising a drive mechanism for continuously rotating the print cylinder with respect to the Anilox metering roll;

a mounting mechanism for supporting the print cylinder for vertical movement with respect to the conveying mechanism and driving the print cylinder into and out of engagement with the surface of the debit card advanced into the flexographic printing station while maintaining sufficient contact with the Anilox metering roll; and a controller connected to the mounting mechanism that receives and processes data regarding the mounting mechanism and configured to control movement of the print cylinder into and out of engagement with the surface of the debit card at a predetermined location and for a predetermined length of time to apply at least one print stripe of predetermined length onto the surface of the debit card based on the length of time the printing surface engages the surface of the debit card.

2. The system according to claim 1, wherein said mounting mechanism is operative such that the setting between the Anilox metering roll and print cylinder is not sufficiently changed to impede adequate transfer of scratch-off coating between the Anilox metering roll and printing surface.

3. The system according to claim 1, wherein said mounting mechanism further comprises a pivot mount member that supports the print cylinder for pivoting motion about a pivot point at a location such that the print cylinder upon pivoting is raised and lowered with respect to the conveying mechanism.

4. The system according to claim 1, wherein comprises a piston actuator having a piston connected to said print cylinder and operative from the controller for actuating piston movement and driving the print cylinder into and out of engagement with a debit card.

5. The system according to claim 1, and further comprising a plurality of parallel print pads forming the printing surface for printing parallel print stripes onto the surface of the debit card.

6. The system according to claim 1, wherein said controller is operative with said mounting mechanism for lowering the print cylinder into engagement with a surface of a debit card a number of times for varying the number and length of print stripes printed on the surface of the debit card.

7. The system according to claim 1, and further comprising an adjustable stop member for limiting downward movement of the print cylinder relative to the conveying mechanism for changing the clearance from the print cylinder and conveying mechanism and adjusting to a different debit card thickness or developing a predetermined pressure to be exerted onto the surface of the debit card.

8. The system according to claim 1, and further comprising an adjustable stop member for limiting upward movement of the print cylinder relative to the conveying mechanism for ensuring that the print cylinder is sufficiently clear of the conveying mechanism for advancing debit cards therebeneath.

9. The system according to claim 1, and further comprising a radiation curing station located along the path of travel for radiation curing the scratch-off coating.

10. The system according to claim 9, wherein said radiation curing station comprises an ultraviolet radiation curing station.

11. The system according to claim 1, and further comprising a printing station for printing a security indicia on the opaque scratch-off coating.

12. The system according to claim 1, and further comprising a flexographic printing station positioned along the predetermined path of travel for printing a release coating onto the surface of the PIN before printing the opaque scratch-off coating.

13. A system for printing, comprising:

a conveying mechanism for sequentially advancing a substrate to be printed along a predetermined path of travel;

a flexographic printing station positioned along the predetermined path of travel for printing at least one print stripe of ink onto the surface of the substrate as the substrate is advanced into the printing station, said flexographic printing station comprising an Anilox metering roll that receives ink to be transferred and a print cylinder having a circumferential printing surface that engages the Anilox metering roll and receives the ink therefrom and transfers the ink to the substrate, and further comprising a drive mechanism for continuously rotating the print cylinder with respect to the Anilox metering roll;

a pivot mount mechanism that supports the print cylinder for pivoting motion such that the print cylinder is driven into and out of engagement with the surface of the substrate advanced into the flexographic printing station while maintaining sufficient contact with the Anilox metering roll such that the setting between the Anilox metering roll and print cylinder is not sufficiently changed to impede adequate ink transfer between the Anilox metering roll and print cylinder; and a controller connected to the pivot mount mechanism that receives and processes data regarding the mounting mechanism and configured to control the pivoting motion of the print cylinder into and out of engagement with the surface of the substrate at a predetermined location and for a predetermined length of time to apply at least one print stripe of predetermined length onto the surface of the substrate based on the length of time the printing surface engages the surface of the substrate.

14. The system according to claim 13, wherein said pivot mount mechanism comprises a piston actuator having a piston connected to said print cylinder and operative from the controller for actuating piston movement and lowering and raising the print cylinder into and out of engagement with the substrate.

15. The system according to claim 13, and further comprising a plurality of parallel print pads positioned on the print cylinder for printing parallel print stripes onto the surface of the substrate.

16. The system according to claim 13, wherein said controller is operative with said pivot mount mechanism for lowering the print cylinder into engagement with a surface of a substrate a number of times and varying the number and length of print stripes printed on the surface of the substrate.

17. The system according to claim 13, and further comprising an adjustable stop member for limiting downward movement of the print cylinder relative to the conveying mechanism for changing the clearance from the at least one print pad and conveying mechanism for adjusting to a different substrate thickness or developing a predetermined pressure to be exerted onto the surface of the substrate.

18. The system according to claim 13, and further comprising an adjustable stop member for limiting upward movement of the print cylinder relative to the conveying mechanism for ensuring that the print cylinder is sufficiently clear of the conveying mechanism and provides sufficient clearance from the conveying mechanism for accommodating different substrate thicknesses to be conveyed into a position for printing.

19. A method of flexographic printing, comprising:

sequentially advancing a planar substrate along a predetermined path of travel into a flexographic printing station;

receiving ink onto a circumferential printing surface of a print cylinder from an Anilox metering roll that engages the printing surface;

rotating continuously the Anilox metering roll and the print cylinder;

supporting the print cylinder on a mounting mechanism and controlling the pivoting of the print cylinder downward by a controller that is connected to the mounting mechanism and receives and processes data regarding the mounting mechanism and configured for controlling the mounting mechanism and print cylinder such that its printing surface engages the surface of the substrate at a predetermined location for a predetermined length of time to apply at least one print stripe of predetermined length onto the surface of the substrate based on the length of time the printing surface engages the surface of the substrate while also maintaining sufficient contact with the Anilox metering roll and ensuring adequate ink transfer from the Anilox metering roll to the printing surface of the print cylinder.

20. The method according to claim 19, which further comprises forming the planar substrate as a debit card and printing a scratch-off coating as the ink over a personal identification number (PIN).

21. The method according to claim 20, which further comprises radiation curing the scratch-off coating.

22. The method according to claim 19, which further comprises printing parallel print stripes of ink onto the surface of the substrate.

23. The method according to claim 19, which further comprises lowering the print cylinder into engagement with a substrate a number of times for varying the number and length of print stripes of ink printed on the surface of the substrate.

24. The method according to claim 19, which further comprises limiting downward movement of the print cylinder for changing its clearance to adjust to various thicknesses of substrate or developing a predetermined pressure to be exerted onto the surface of the substrate.

25. The method according to claim 19, which further comprises limiting upward movement of the print cylinder accommodating for thicker substrates.

* * * * *